United States Patent [19]

Muirhead

[11] 3,939,519

[45] Feb. 24, 1976

[54] CONDENSER TUBE CLEANING PLUG

[76] Inventor: Walter B. Muirhead, Rte. 2, Box 155, Jasper, Tenn. 37347

[22] Filed: Jan. 16, 1974

[21] Appl. No.: 433,875

[52] U.S. Cl. ..... 15/104.06 R

[51] Int. Cl.[2] ..... B08B 9/04

[58] Field of Search ..... 15/104.06 R, 104.06 A, 15/3.5, 3.51

[56] References Cited

UNITED STATES PATENTS

| | | | |
|---|---|---|---|
| 2,276,109 | 3/1942 | Smith | 15/104.06 R |
| 2,972,156 | 2/1961 | VerNooy | 15/104.06 R |
| 3,047,895 | 8/1962 | VerNooy | 15/104.06 R |
| 3,619,844 | 11/1971 | Collins et al. | 15/104.06 R |

*Primary Examiner*—Edward L. Roberts

[57] ABSTRACT

A cleaning plug especially adapted for condenser tubes or the like and designed to be propelled through the tube by differential fluid pressure includes an elongated core body and a plurality of spaced scraper discs along the body. The discs have radial slits formed from adjacent the body to the outer periphery to define annular segments. The segments are flexible to readily deflect when the plug is placed in a confining tube and to give full peripheral scraping action. The discs are sufficiently larger in outside diameter than the inside of the tube and the slits are sufficiently narrow to cause the outer tips of the segments to touch each other during the cleaning operation. The segments are sufficiently flexible to snap past each other and overlap when the tube diameter is reduced. The inner portion of the slits form opening means for passage of propelling fluid and foreign matter and to dislodge foreign matter forward of the plug. An axial passage through the core body may also be provided for this purpose. Preferably seven or more discs are utilized for the most efficient cleaning of the tube. The disc segments are integrally molded with the core body and the entire plug is fabricated of high density polyethylene. Specific dimensional limitations for nominal ⅞ inch outside diameter tubes are given. Projection means may be provided to space tandem plugs and the slits may be offset in the longitudinal direction to increase agitation action between the discs and to improve forward motion producing positive pressure.

14 Claims, 10 Drawing Figures

CONDENSER TUBE CLEANING PLUG

FIELD OF THE INVENTION

The present invention relates to cleaning of condenser tubes or the like, and more specifically, to an improved cleaning plug giving low cost, high efficiency cleaning results.

BACKGROUND OF THE INVENTIN

Today, as perhaps never before, with the world's energy resources declining and energy companies unable to keep up with the demand, it is imperative that all possible measures be taken in order to conserve fuel and electricity that is used. In power plants, as well as industrial processes and air conditioning systems, condensers play an important role in conversion of heat to usable energy. The efficiency of operation of the condenser directly affects the efficiency of conversion so that an increase in condenser efficiency gives an increase in total energy conservation.

To illustrate this principle, one might consider a typical steam plant operation where the net heat rate is approximately 9,500 BTU per kilowatt hour; i.e. the plant will produce 1 kilowatt hour per 9,500 BTU of heat generated. Utilizing empirical data, it has been determined that when the condenser cleanliness factor is improved from, say 50 to 85 percent a corresponding decrease in heat rate is approximately 2 percent. Thus, if the condenser is kept on the average at 85 percent cleanliness factor it will take 190 less BTU per kilowatt hour to operate the steam plants. Perhaps more revealing is the savings in terms of dollars, which works out to about $20,000 per month in direct fuel cost savings.

In addition to saving of energy, providing a more efficient cleaning of the condenser gives benefits in terms of environmental protection. With the increase of heat transfer efficiency brought about by the cleaner walls of the tubes, a lower discharge temperature of the cooling water by several degrees is realized. This protects the rivers and lakes from growth of algae, fish kill and other deleterious side effects.

With the need for more efficient cleaning of condensers, identified both in terms of better cleaning and the speed with which a condenser can be cleaned, I have looked to the areas that might be identified where advantages can be gained. First, the basic system for cleaning tubes comprising passing a plug through the tube to scrape the interior wall has been proven over many years of successful operation and experience, so that no change here is indicated. This then leads directly to improvement of the mechanical design of the heart of the system, and that is the plug itself. One of the first systems for cleaning condensers, shown in the U.S. Patent to Penn No. 1,547,440 typifies the recognition that is given to the importance of the form of the plug to the efficiency of the system. In this patent, and the many that follow, plugs of different configurations have been invented in an attempt to increase the efficiency of the cleaning operation. Most of these plugs have been for use with air, steam or water as the propelling medium and most have been fabricated of resilient rubber. In addition, brushes in combination with solid rubber plugs, plugs with metal scraping blades and even short lengths of rope have been suggested by others in the quest for increased cleaning efficiency. Thus, while the plugs have worked sufficiently to prove the basic soundness of the cleaning system, today, especially with the energy crises and the need for environmental protection becoming paramount, the previous designs are deemed not to be good enough and an even more efficient design in the plug of the cleaning system is needed. With this background in mind, my invention has been developed to accomplish the following objectives.

OBJECTIVES OF THE INVENTION

Accordingly, a basic object of the present invention is to provide a plug that is more efficient in design for removing foreign matter from a condenser tube, while at the same time being inexpensive to allow large numbers to be used in a single cleaning operation.

It is another object of the present invention to provide a cleaning plug that has a plurality of flexible cleaning discs, each disc having segments whose tips at least touch, assuring substantially full peripheral scraping inside the tube.

It is another object of the present invention to provide a cleaning plug wherein the discs for scraping are self-adjusting to the diameter of the tube by virtue of the tips of the segments snapping past each other and overlapping.

It is still another object of the present invention to provide a cleaning plug structure that will not damage the tubes, will not hang in the tubes and may be easily retrieved for reuse.

BRIEF DESCRIPTION OF THE INVENTION

According to the present invention a cleaning plug or slug is provided for condenser tubes or the like having an elongated core body with scraper discs spaced axially along the body. Each of the discs is mounted for separate scraping action so that in effect a series of foreign matter removing wipes are made during the passage of each plug through the tube. The successive acting scraper discs remove the build up of slime, mud and algae in layers and do so more effectively than in the past. Specifically, in the preferred embodiment, a series of seven single, separate scraper discs are provided on each cleaning plug. The first disc in line picks up a large proportion of the foreign matter, but by its scraping action also loosens the next lower layer of build up. This then is picked up by the next disc and so on down to the last disc for greater cleaning efficiency.

The seven discs provide a plug that is most easily and efficiently manufactured, while at the same time giving cleaning performance satisfactory to most tube cleanliness conditions. In certain instancnes, more than seven discs will be preferred to give added cleaning capability and thus a wider range of use. But, by the same token, less discs can be satisfactorily used where the cleaning operation is performed on a more frequent basis, for example. As an alternative to more discs on a single plug and/or still greater cleaning capability, two or even more plugs of variable sizes may be used in tandem.

The scraper discs are specifically designed with radial slits extending from adjacent the core body to the outer periphery to thereby form annular, flexible scraping segments. This allows the discs to better conform to the interior wall of the tube due to a desired increased flexibility of the segments. Of significant importance is the sizing of the disc relative to the tube. Each disc should be sufficiently larger than the inside of the tube to be cleaned and with the slits sufficiently narrow so as to cause the adjacent outer tips of the segments to at least touch each other, thereby providing substantially full peripheral scraping action.

As the discs move through a tube of a reduced diameter, the segments are flexible enough to snap past each other and overlap. With this overlapping feature, the full periphery of the tube is still assured of being cleaned and allows the plugs to be used for a range of tubes with different inside diameters. For example, in use with a ⅞ inch nominal size condenser tube, the discs are made with an outer diameter of 0.820 inch, four slits are positioned along equally spaced (90°) radii, and the slits are approximately 1/32 inch in width. With this size and configuration, the desired scraping action can be obtained in all ⅞ inch nominal size tubes from 16–22 BWG gauge manufacture. In the Example, the plug is made of molded, high density polyethylene and the discs are 0.0312 inch thick to give the desired resiliency or flexibility. Of course, for different nominal size tubes, such as ¾ inch or 1 inch diameter tubes, plugs with correspondingly determined dimensions are fabricated.

In accordance with another important aspect of the present invention, the inner portion of the slits form opening means for passage of propelling fluid between the several discs in order to agitate and advance the foreign matter. An axial passage may also extend through the core body with a forward nozzle adapted to eject a stream to aid in the agitation action preceding the traveling plug.

The low cost production of the cleaning plugs is gained by integrally molding the core body and the disc segment from plastic with the center of the core being hollow thereby using a minimum of material. With the integral feature also comes the advantage of unit integrity, unlike some previous designs where a plurality of mechanical parts are subject to becoming loose after extended use. The preferrred polyethylene has been found, through testing, to form peripheral disc edges that are highly efficient in removing the foreign matter without the need for sharp, special metal scraper pieces used in the past. The tubes are thus not subject to inordinate wear due to cleaning.

In some instances, tandem plugs may be used for greater cleaning capacity. A forwardly extending projection adapted to mate with the rear end of the leading plug may be used to assure spacing of the first disc in the following plug. The slits in the discs may be longitudinally offset to increase agitation action in the cleaning chambers between the spaced discs and to provide additional reaction surface for forward motion producing fluid pressure. The density of the molded plugs is preferably less than that of water in order to assure flotation in the water box at the discharge end of the tube bundle being cleaned. This allows the plugs to be conveniently drained from the top of the reservoir and speedily recovered in a perforated basket from an overflow.

Still other objects and advantages of the present invention will become readily apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE INVENTION AND THE EMBODIMENT

With reference now to the drawings, the concepts of the present invention can be described in accordance with several alternative embodiments and a preferred embodiment or best mode shown in FIGS. 3–6*a*. The plug of the present invention is designed to be utilized for cleaning condenser tubes, but can be used in a similar form for other types of cleaning applications to hollow cylindrical members. The plug is designed to be propelled through the tube by differential fluid pressure across the plug. Opening means through the plug provides passage of a limited amount of the fluid to agitate and advance foreign matter through confined cleaning chambers and forward of the plug. The opening means is, of course, sufficiently restricted to maintain the required differential pressure.

Figure 1:
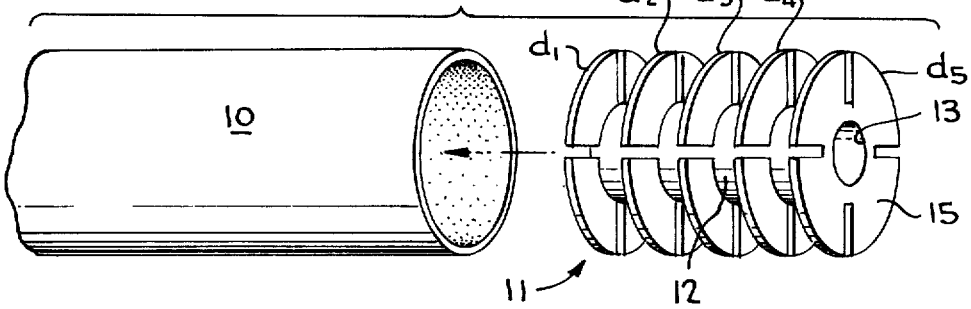
FIG. 1 is a perspective view of one form of cleaning plug with multiple discs in position for insertion into a tube to be cleaned.

Thus, with reference to FIG. 1, a conventional condenser tube 10 is shown with a cleaning plug 11 of the invention positioned for insertion into the open end. In accordance with the invention, the plug is provided with a central core body 12 that extends along the longitudinal axis of said plug 11. A plurality of axially spaced scraper means, in the form of single, spearate scraper discs, designated by the reference numerals $d_1$–$d_5$, are mounted on the elongated core body 12.

In use, it will be apparent that the plug 11 is manually inserted into the opening in the tube 10, and is then propelled through the tube by the fluid pressure and exits at the opposite end (not shown). During the movement through the tube, the single discs $d_1$–$d_5$ are separated and serve to individually scrape the inside wall in a manner to thoroughly clean the wall of foreign matter, such as slime, mud and algae that can build up after a period of use. Each disc loosens the next lower layer of built up foreign matter for easier removal by the next disc in line. In the embodiment shown in FIG. 1, the first and last disc $d_1$, $d_5$ are mounted adjacent the ends of the plug 11 to provide cleaning action along the full length of the plug and minimum material cost. The core body 12 is hollow, as shown by the passage 13 (see FIG. 1), which feature also minimizes material cost, but also forms a portion of the restricted opening means that allows through flow of fluid, mentioned above and to be explained in greater detail below.

Figure 2:
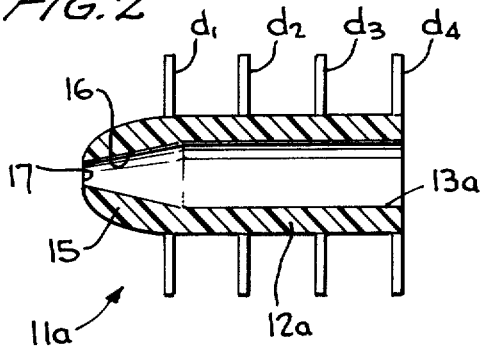
FIG. 2 is another form of the cleaning plug showing a reduced number of cleaning discs and a forward projection for spacing of tandem plugs.

In FIG. 2, there is shown a cross-sectional view through a second embodiment of the cleaning plug constructed in accordance with the broader principles of the present invention. This plug 11*a* is designed to work by passage through the condenser tube 10 in essentially the same manner as the plug 11, but has one less scraper disc, or only disc $d_1$, $d_2$, $d_3$, $d_4$, with the forward portion of the core body 12*a* being formed by a rounded nose or projection 15 (see FIG. 2).

Inside the projection 15 is a tapered nozzle 16 that is operative to increase the velocity of the fluid traveling through the hollow interior passage 13*a*. This nozzle terminates in an exit orifice 17 from which the fluid emerges and sprays in front of the traveling plug 11*a* in order to agitate and initially loosen the foreign material attached to the inside walls of the tube 10.

From the first two embodiments shown, it can be seen that the number of discs d can vary as desired or needed. Each disc d performs an independent and a separate scraping action on the walls and, according to several parameters established in each tube bundle to be cleaned, such as the amount and type of deposits, plugs of different length can be selected for each job as required. In each instance, the leading disc $d_1$ scrapes the major portion of the foreign matter and moves it forward toward the exit end of the tube 10. The fluid, which is preferably water, is sprayed on the wall to initially loosen the matter in preparation for the successive scraping operations. As the disc $d_1$ moves through the tube 10 it loosens the next layer of the foreign matter as it scrapes, and each following or successive disc $d_2$–$d_5$ does the same. In turn, each following disc $d_2$–$d_5$ also picks up the loosened foreign matter dislodged by the immediately preceding disc, confines the matter in each successive cleaning chamber C (see FIG. 5) and allows the matter to be carried to the end of the tube 10 either in the chamber or by the fluid passing through the opening means.

Figure 3:
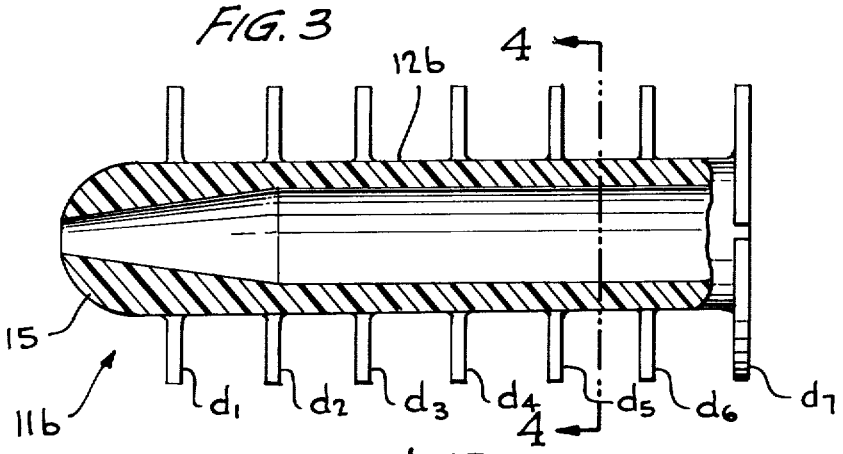
FIG. 3 is a side view, partially in cross-section, of the preferred embodiment and of the invention including seven discs.

Moving on to FIG. 3, there is shown still another cleaning plug 11*b* that has from tests been shown to be the preferred embodiment or the best mode of carrying out the present invention. The plug 11*b* has seven discs $d_1$–$d_7$ that are separately spaced along the core body 12*b* and each serves to scrape the inside wall of the tube, as in the previous two embodiments disclosed above. The seven discs appear to give the best overall complete cleaning action in condenser tubes. The characteristic build up of foreign matter in these tubes has been tested and studied, and it has been found that by the time the last disc $d_7$ passes through, a highly satisfactory cleaning job has been done in the typical operation.

Figure 4:
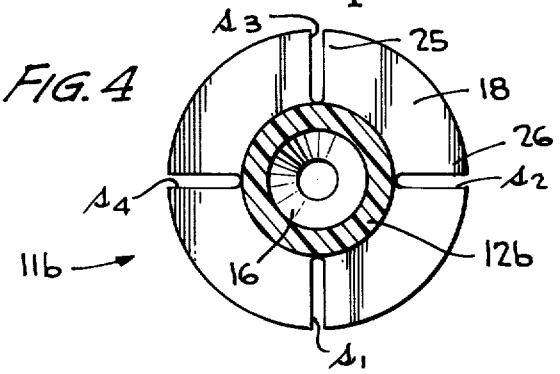
FIG. 4 is a cross-sectional view taken along line 4—4 of FIG. 3 showing the discs in plan view and the segment forming slits.

FIG. 4 is a cross-sectional view showing the prpvision of slits extending from adjacent the core body 12*b* to the outer periphery. The slits are designated $s_1$, $5_2$, $s_3$, $s_4$ in each of the embodiments described. There are preferably four slits on each disc *d* spaced 90° apart and adjacent slits form annular segments 18 (see FIGS. 1 and 4). The slits $s_1$–$s_4$ serve an important function in the operation of the cleaning plug of the present invention, as will be apparent below.

First, it should be noted that the core body 12 and the discs $d_1$–$d_7$ of all embodiments are integrally formed of a resilient plastic material, such as polyethylene. The disc segments 18 are physically flexible so as to readily deflect when the plug is placed in a confining tube to be cleaned, and to imporve that flexibility, the slits $s_1$–$s_4$ are provided. Although four slits are shown in the included embodiments, it is understood that acceptable operation could be obtained with more or less slits. The segments 18 should be of equal segment length so that equal resiliency is provided, whereby the core 12 is automatically centered in the tube 10 for equal peripheral scraping action.

The leading edge of each segment 18 is of course the working part that engages the interior wall. My tests have proven the polyethylene material edge to be sharp enough to successfully bite into the deposits or layers of foreign matter for good removal, much to the surprise of some experts. At the same time, the wearing characteristics of the edge are excellent and virtually no harmful wearing of the interior wall of the tube 10 results, as has been a problem in the past. The plastic material also lends itself well to the possibility of molding minute abrasive particles, such as communitated silicon carbide or aluminum oxide, into the scraping edge if conditions warrent the same.

Figure 5:
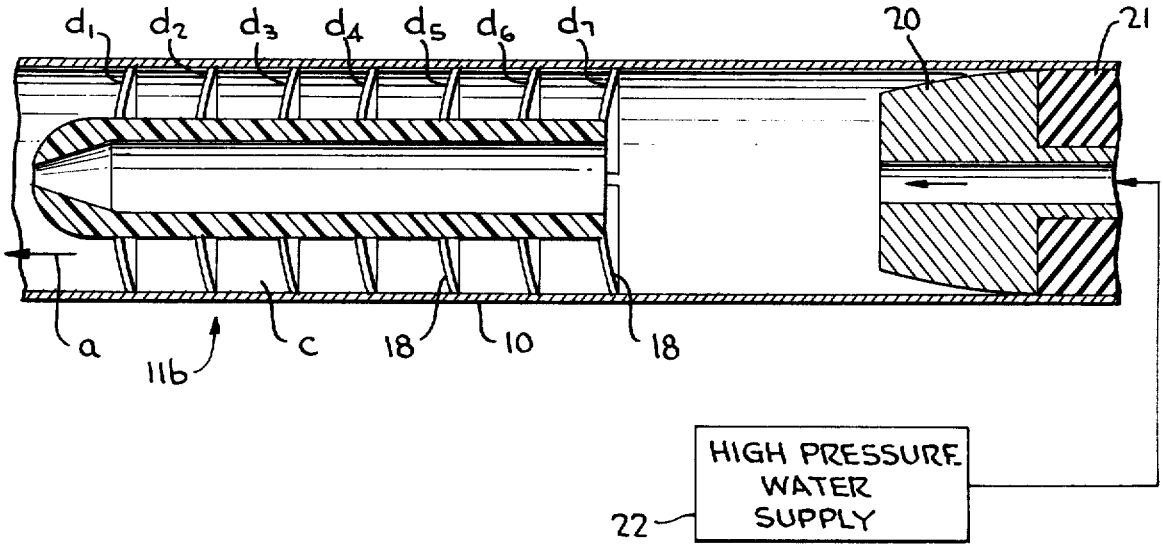
FIG. 5 is a cross-sectional view of the preferred embodiment in use for cleaning a tube.

A showing of the cleaning plug embodiment 11*b* actually positioned in the condenser tube 10 in readiness for a cleaning operation can be seen in FIG. 5. In this Figure, it will be noted that the individual segments 18 of the discs $d_1$–$d_7$ are flexed rearwardly in relation to the direction of travel of the plug, as denoted by the direction arrow *a*. Each of the discs $d_1$–$d_7$ scrape a portion of the deposits from the interior wall surface of the tube 10 and push the same forward as the plug moves along. In addition, each disc loosens the next layer down and this is then picked up by the next succeeding disc. When all seven discs have passed through the tube 10, the cleaning operation is normally completed.

The propulsion for the plug 11*b* may be provided by a suitable gun (not shown) designed to eject high pressure fluid from a nozzle 20, shown in FIG. 5. On the nozzle 20 is a rubber sealing sleeve or grommet that is automatically expanded to seal against the interior wall of the tube 10 when high pressure fluid, preferably water, is introduced from a suitable supply 22. When the plug 11*b* has exited the far end of the tube 10, the injection of water is terminated by the operator, the expanded sleeve 21 retracts and the gun may be easily removed and placed in the next tube of the tube bundle to continue the cleaning of the condenser.

In certain cleaning applications where the deposits prove to be more difficult to remove, it may be desirable to use more than one of the cleaning plugs 11, 11*a* or 11*b* in tandem to get the desired results. In this instance, either of the plugs 11*a* or 11*b* that have the projection 15 should be used as the following plug so that the projection 15 provides a spacing function between the first disc $d_1$ and the final disc of the leading plug. In this manner, the disc $d_1$ can not come into juxtaposition with the final disc of the previous plug and can therefore operate most efficiently in a separate manner for removing the foreign matter. This is also important in order to allow continuous, but restricted, flow of the liquid through the opening means formed by the inner portions of the slits $s_1$–$s_4$.

With reference to FIGS. 4–6*a*, when the plug 11*b* is in the tube 10, the segments 18 are flexed rearwardly into the scraping position with the leading edge of each disc in effect resiliently biting into the foreign matter deposits. According to the broad aspects of the present invention, the discs ar sufficiently larger in diameter than the inside diameter of the tube 10 to be cleaned and the slits $s_1$–$s_4$ are sufficiently narrow to cause the tips 25, 26 of the segments 18 substantially to at least touch the adjacent tips. When this is done, full peripheral scraping action by each disc $d_1$–$d_7$ is accomplished. The inner portion of the slits $s_1$–$s_4$ form the opening means for passage of fluid forward to agitate and advance foreign matter between each successive chamber *c* and eventually forward of the plug as the same moves along the tube. These triangular openings are designated in FIG. 6 by reference numeral 27.

Figure 6:
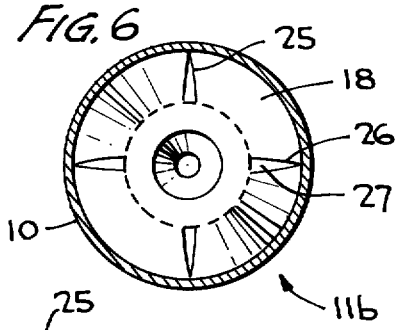
FIG. 6 is an end view of the plug showing the last disc flexed in the confining tube with the tips of the segments just touching each other.
Figure 6A:
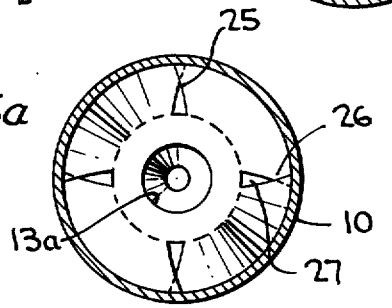
FIG. 6*a* is a showing of the disc, the same as in FIG. 6, but with the tips of the segments overlapping.

As the diameter of the tube becomes smaller, the tips 25, 26 are designed to coact with the adjacent abutting tips so as to snap past each other and form overlapping relationships, as shown in FIG. 6*a*. This assures that the full peripheral scraping action of the inside wall is maintained. As noted too, this feature allows one size of cleaning plug to be used for several close sizes of tubes.

The following data is important to show the specific relationships of the present invention, which specifics allow the interaction of the segments 18 to perform the function as described:

For ⅞ inch O.D. tube (nominal size, condenser type, 16-22BWG)

| | |
|---|---|
| Outside diameter of disc | .820" |
| Thickness of disc | .0312" |
| Width of slit in disc | 1/32" |
| Material | High density polyethylene |

Generally, a separate cleaning plug is required for each nominal size tube, but as it can be seen from the example above, one size will fit a range of internal diameter tubes so that the most universal use possible may be made of the plugs. As the tubes get smaller, the overlap increases as shown in FIG. 6*a*, thereby further reducing the triangular openings 27 in proportion and thus increasing the differential pressure that is operating in each successive cleaning chamber C (see FIG. 5) to substantially equally offset the increased frictional drag. The water being used as the cleaning medium flows through each of the openings 27; however, the total restriction (including passage 13) is maintained sufficiently small to provide the necessary differential pressure across the disc that is required to keep the plug moving at the desired scraping speed through the tube 10. On the other hand, the openings 17 are sufficiently large to allow the water and entrained foreign matter to be moved from each chamber *c* through the plug 11 at a controlled rate sufficient to obviate any chance of clogging within any one individual chamber *c*. Since the discs $d_1$–$d_7$ are slightly cup-shaped directed to the rear, the positive pressure behind each disc will be effective in providing the moving force.

Figure 7:
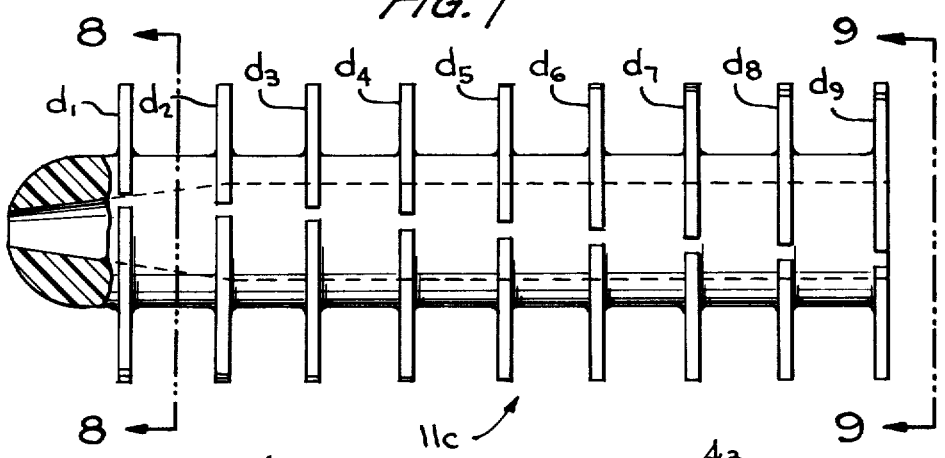
FIG. 7 is a side view, also partially in cross-section, showing still another embodiment and with the positioning of the slits offset along the longitudinal axis of the plug.
Figure 8:
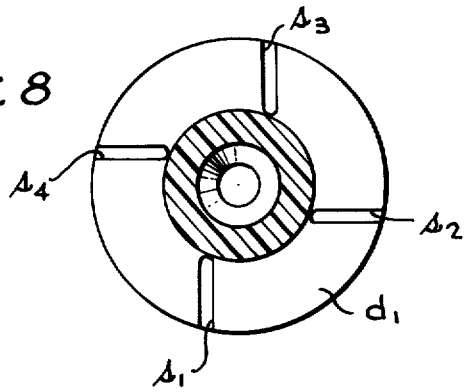
FIGS. 8 and 9 are views taken along corresponding lines 8—8 and 9—9 of FIG. 7, showing the offset from the radial position of the first and last combination of slits.
Figure 9:
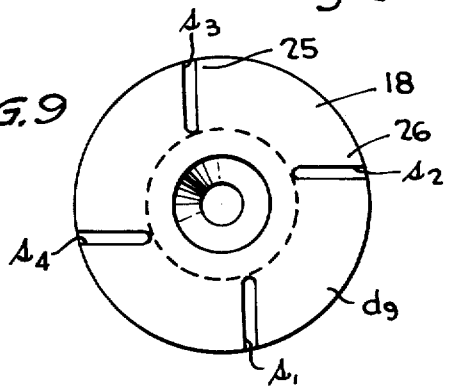

A fourth alternative embodiment of the plug, plug 11*c* is shown in FIGS. 7–9 of the drawings, and will be briefly described, for the purpose of still further elucidating the teaching of utilizing the number of discs and/or plugs in tandem to give maximum efficiency in a particular situation. In this embodiment the discs have been increased to nine ($d_1$–$d_9$). As the number of discs is increased, the frictional force against movement through the tube 10 is increased proportionally and greater driving force is thereby required. One arrangement where an increase in driving force can be gained is shown wherein the slits $s_1$–$s_4$ are angularly offset in small increments from the radial position at disc $d_5$ in one direction toward the rear disc $d_9$ and in the other direction toward the front disc $d_1$. This means that the fluid passing through the triangular openings 27 does not squarely hit the opening 27 next in line and, therefore, an increased differential pressure area is provided that generates additional forward thrust on the plug 11*c*. The non-alignment of the slits $s_1$–$s_4$ also assures greater agitation and turbulence within each chamber *c* to dislodge the deposits along the full extent of the plug.

The closing of the tips 25, 26 (see FIG. 9) between adjacent segments 18 of successive discs $d_1$–$d_9$ at different angular positions further assures against any tendency for the discs to cause streaking during the scraping operation. The relative positioning of the slits $s_1$–$s_4$ in this embodiment can be parallel and progressively shifted from one side of the slit in the disc $d_5$, which is radial, toward the ends. As shown in FIG. 8, the end disc $d_1$ has the slits $s_1$–$s_4$ rotated clockwise, a maximum from the radial position in the disc $d_5$, and conversely, the slits $s_1$–$s_4$ on end disc $d_9$ are rotated counterclockwise a maximum (FIG. 9).

In summary, it can be seen that the cleaning plug 11 of the present invention in any one of the disclosed embodiments or equivalent, is designed for efficient cleaning action and for low cost production through one piece, integral molding. The discs *d* are sized in diameter in order to be sufficiently larger than the inside of the tube to be cleaned and the slits $s_1$–$s_4$ sufficiently narrow so that the outer tips of the segments 18 at least touch when the core body 12 is centered along the axis of the tube during the cleaning operation. This closing of the peripheral scraping edge along each disc *d* is important to assure a substantially full cleaning pattern of each individual disc. The water or other cleaning liquid being used to propel the plug 11 provides agitation to the foreign matter in each cleaning chamber C, and assures limited forward movement of the material as it is scraped free through the triangularly shaped openings 27 formed by the inner portion of the slits $s_1$–$s_4$. The scraping segments 18 are sufficiently flexible to allow the tips to snap past each other and overlap when the inside diameter of the tube is reduced, and thus allows a range of tubes to be cleaned with a single model or size plug 11. Additional fluid may be ejected through the nozzle 15 at the front of the plug 11 and the projection forming the nozzle provides a spacer means for tandem plugs cleaning together in a single operation. The slits $s_1 s_4$ may be all radial and in line (FIGS. 1–6), or moved progressively from a radial position on the center disc in opposite directions so as not to provide alignment, as shown in FIGS. 7–9.

In this disclosure, there is shown and described only the preferred embodiments of the invention, but, as aforementioned, it is to be understood that the invention is capable of use in various other combinations and environment and is capable of changes or modifications within the scope of the inventive concept as expressed herein.

What is claimed is:

1. A cleaning plug for condenser tubes or the like adapted to be propelled through a tube to be cleaned by differential fluid pressure comprising:

an elongated core body for support of a plurality of axially spaced scraper means, said scraper means comprising a plurality of single, separate scraper discs, said scraper discs having slits extending from adjacent said body to the outer periphery to form annular segments, said slits being open on both sides of said discs, each of said discs being separated from the adjacent disc, said annular segments being axially flexible so as to readily deflect when said plug is placed in a confining tube to be cleaned, said discs being sufficiently larger in outside diameter than the inside diameter of said tube to be cleaned and said slits sufficiently narrow to cause the outer tips of said segments to at least touch when said core body is centered in said tube for cleaning action, whereby substantially full peripheral scraping action of the inside wall of said tube by each single disc is gained.

2. The cleaning plug of claim 1 wherein the inner portion of said slits form opening means for passage of propelling fluid forward to agitate and advance foreign matter forward of said plug during cleaning action.

3. The cleaning plug of claim 2 wherein said opening means is sufficiently restricted during cleaning action to maintain sufficient differential pressure across said discs to normally move said plug along said tube, but sufficiently open to allow limited forward movement of foreign matter with the fluid from between said discs.

4. The cleaning plug of claim 3 wherein said opening mens further comprises an axial passage through said core body, said passage terminating at a forward orifice defining a nozzle to aid in the agitation during the cleaning action.

5. The cleaning plug of claim 1 wherein said disc segments are integrally molded of plastic with said core body for low cost production and unit integrity.

6. The cleaning plug of claim 5 wherein said plastic is high-density polyethylene for high scraping efficiency while minimizing damage to said tubes and for long life.

7. The cleaning plug of claim 1 wherein said segments are sufficiently flexible so that said tips snap past each other and overlap when said inside diameter of said tube is reduced during cleaning action.

8. The cleaning plug of claim 1 wherein the condenser tube to be cleaned is nominally ⅞ inch outside diameter and 16–22 BWG gauge, said discs being approximately 0.820 inch, said slits being approximately 1/32 inch, and said discs being approximately 0.0312 inch thick.

9. The cleaning plug of claim 1 wherein said plug is provided with approximately seven discs to assure adequate cleaning of the tube.

10. The cleaning plug of claim 1 wherein the forward end of said plug includes projection means to mate with the rear end of another plug, the first disc of said plug being spaced rearwardly of said projection means, whereby said plug may be used in tandem with all discs spaced for more complete cleaning action.

11. The cleaning plug of claim 1 wherein said slits are longitudinally offet along the plug to increase agitation action and forward motion producing positive pressure.

12. The cleaning plug of claim 1 wherein the density of said plugs is less than water to allow the same to be recovered by flotation.

13. The cleaning plug of claim 1 wherein said slits define openings between said segments when said plug is unconfined outside said tube, said openings having a substantially uniform width extending from adjacent said core body to the outer periphery of said segments, said openings allowing passage of propelling fluid forward to agitate and advance foreign matter forward of said plug during cleaning action.

14. The cleaning plug of claim 13 wherein said openings are reduced when said plug is confined in said tube for cleaning action, said openings during the cleaning being adjacent said core body and substantially triangular shaped.

* * * * *